US007427255B2

(12) United States Patent
Fan

(10) Patent No.: US 7,427,255 B2
(45) Date of Patent: Sep. 23, 2008

(54) TWIST STATIONARY BIKE

(75) Inventor: Jeeng-Neng Fan, Taoyuan (TW)

(73) Assignee: Hsin Lung Accessories Co., Ltd., Hsin-Chu Hsien (TW)

( * ) Notice: Subject to any disclaimer, the term of this patent is extended or adjusted under 35 U.S.C. 154(b) by 645 days.

(21) Appl. No.: 10/978,452

(22) Filed: Nov. 2, 2004

(65) Prior Publication Data

US 2005/0101449 A1 May 12, 2005

(30) Foreign Application Priority Data

Nov. 7, 2003 (TW) ..... 92219826 U

(51) Int. Cl.
*A63B 69/16* (2006.01)

(52) U.S. Cl. ..... 482/57

(58) Field of Classification Search ..... 482/51, 482/52, 57–65
See application file for complete search history.

(56) References Cited

U.S. PATENT DOCUMENTS

| | | | | | |
|---|---|---|---|---|---|
| 4,711,447 | A * | 12/1987 | Mansfield | 463/37 |
| 5,035,418 | A * | 7/1991 | Harabayashi | 482/62 |
| 5,908,373 | A * | 6/1999 | Pitre | 482/57 |
| 5,931,765 | A * | 8/1999 | Huang | 482/57 |
| 5,967,610 | A * | 10/1999 | Lin | 297/340 |
| 6,793,609 | B1 * | 9/2004 | Fan | 482/57 |

* cited by examiner

*Primary Examiner*—Steve R Crow
(74) *Attorney, Agent, or Firm*—Troxell Law Office, PLLC

(57) ABSTRACT

A twist stationary bike of a fitness equipment including a pedal driven vertical shaft provided on the bike frame, a turning bar located on a top of the shaft, a seat pivotally connected to an end of the turning bar for a user to sit on and to step on pedals to revolve the vertical shaft for naturally twisting the waist and swinging the buttock of the user to achieve a fitness purpose.

8 Claims, 6 Drawing Sheets

TWIST STATIONARY BIKE

BACKGROUND OF THE INVENTION (a) Field of the Invention

The present invention is related to a stationary bike, and more particularly, to one that permits the user to twist and swing a waist and buttock at the same time as pedaling for achieving the purpose of staying fit.

(b) Description of the Prior Art

Conventional indoor fitness equipment provides a solution for the people to enjoy sports and exercises. A stationary bike is very popular and more acceptable to the users because of its size, and it does not demand as much physical strength as a running machine. However, the stationary bike functions only to simulate riding a real bike. It provides limited work out purpose and gets too boring for the user to maintain regular exercise.

SUMMARY OF THE INVENTION

The primary purpose of the present invention is to provide a stationary bike that allows the user to work out his waist and buttock at the same time as riding the stationary bike. To achieve the purpose, a vertical shaft driven by the pedal is erected on the frame of the bike. A turning bar that turns along with the vertical shaft is laterally disposed at a top of the vertical shaft; and a seat is pivotally connected to the tail of the turning bar. The user while stepping upon the pedals naturally twists his waist and swings his buttock at the same time as pedaling to achieve the purpose of staying fit.

DETAILED DESCRIPTION OF THE PREFERRED EMBODIMENTS

Figure 1:
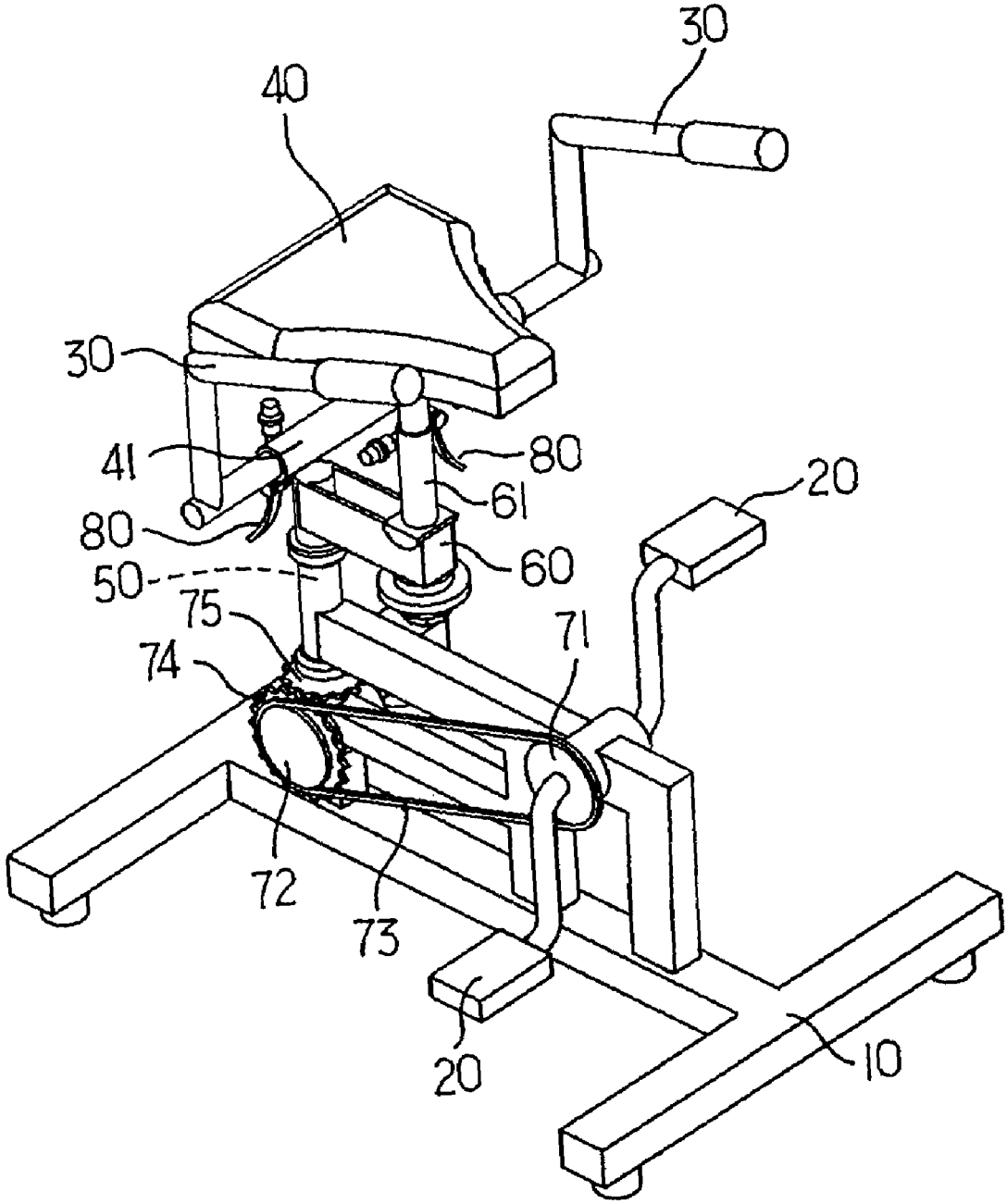
FIG. 1 is a perspective view of a preferred embodiment of the present invention.
Figure 2:
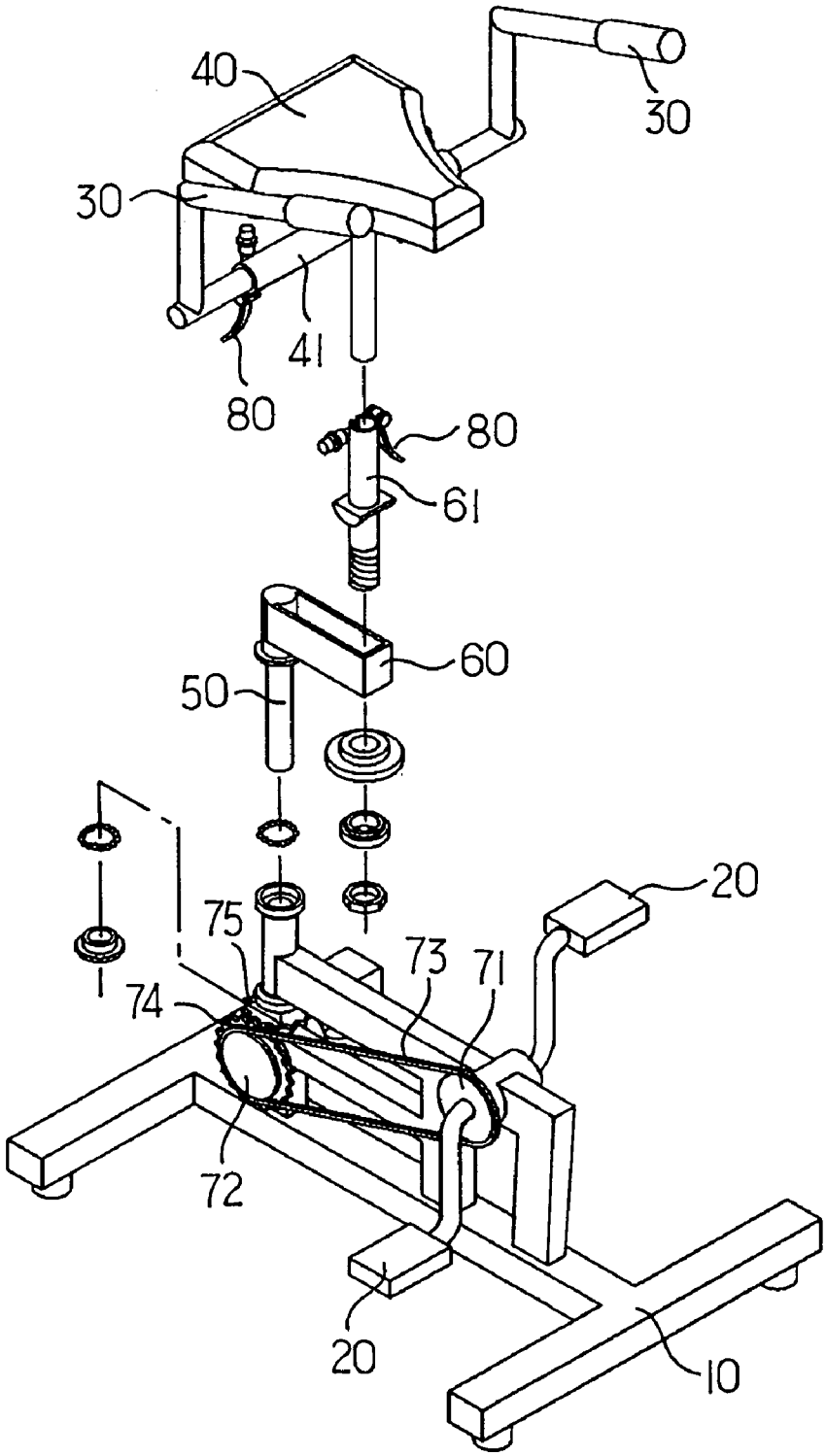
FIG. 2 is an exploded view of the preferred embodiment of the present invention.

Referring to FIGS. 1 and 2, a preferred embodiment of the present invention includes a frame 10, a pair of pedals 20 provided on the frame 10, a seat 40 provided at a rear of the frame 10 for a user to sit on and step on the pedals 20 to simulate riding a real bike for exercise purpose.

Figure 5:
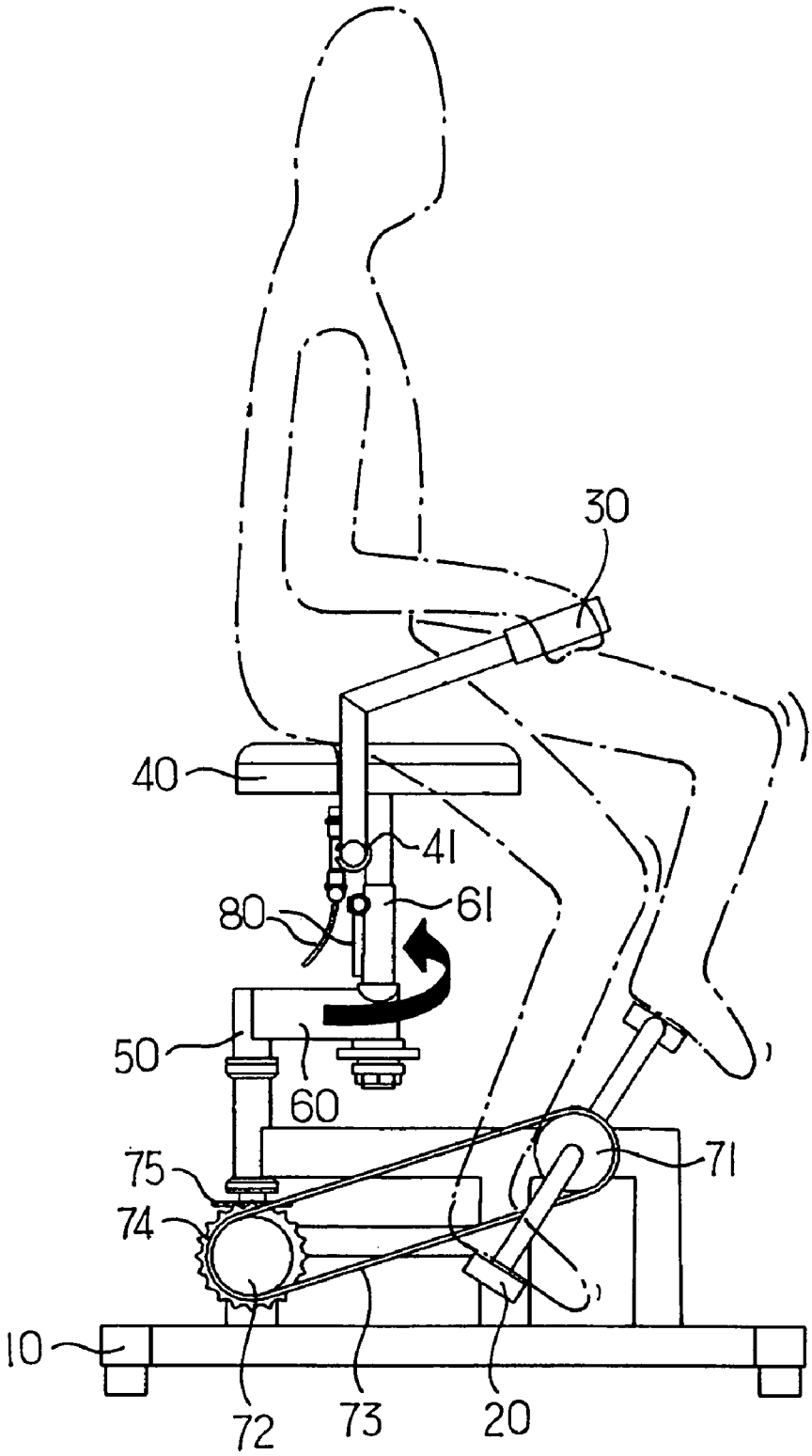
FIG. 5 is schematic view showing a status of the preferred embodiment of the present invention is in use.

A vertical shaft 50 driven by both pedals 20 is separately disposed to the frame 10. A turning bar 60 turning along with the vertical shaft 50 is provided on a top end of the vertical shaft 50, a sleeve 61 is pivoted with a bearing (not marked) on a tail of the turning bar 60, and the seat 40 is inserted from a top into the sleeve 61. As illustrated in FIG. 5, the user sits on the seat 40 and steps on both of the pair of pedals 20 alternatively to drive the seat to revolve along with the vertical shaft

50 while the bearing helps maintain smooth revolution of the seat 40 on the sleeve 61 to twist the waist and swing the buttock of the user.

Figure 3:
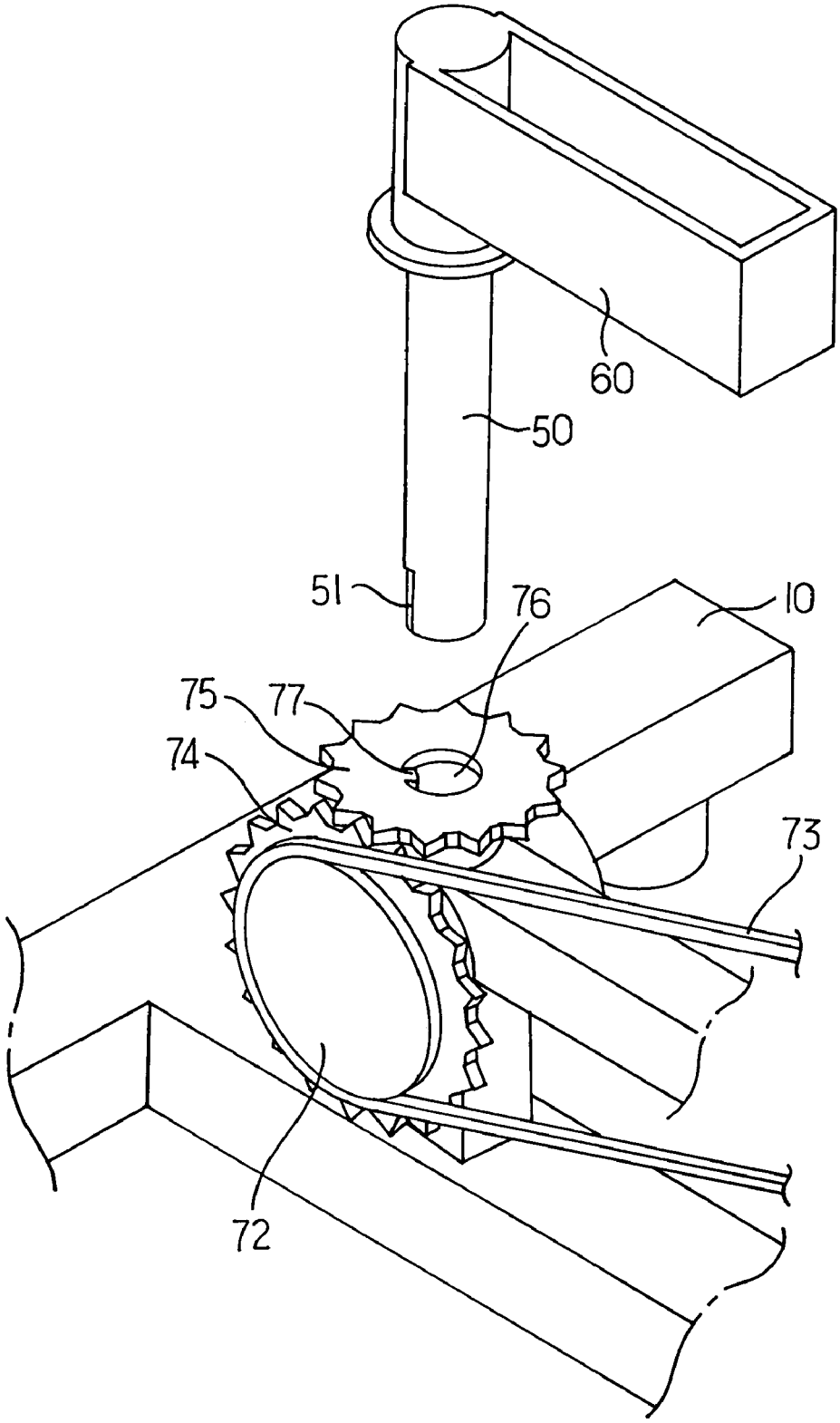
FIG. 3 is an exploded view showing an assembly of a vertical shaft and a second gear of the preferred embodiment of the present invention.
Figure 4:
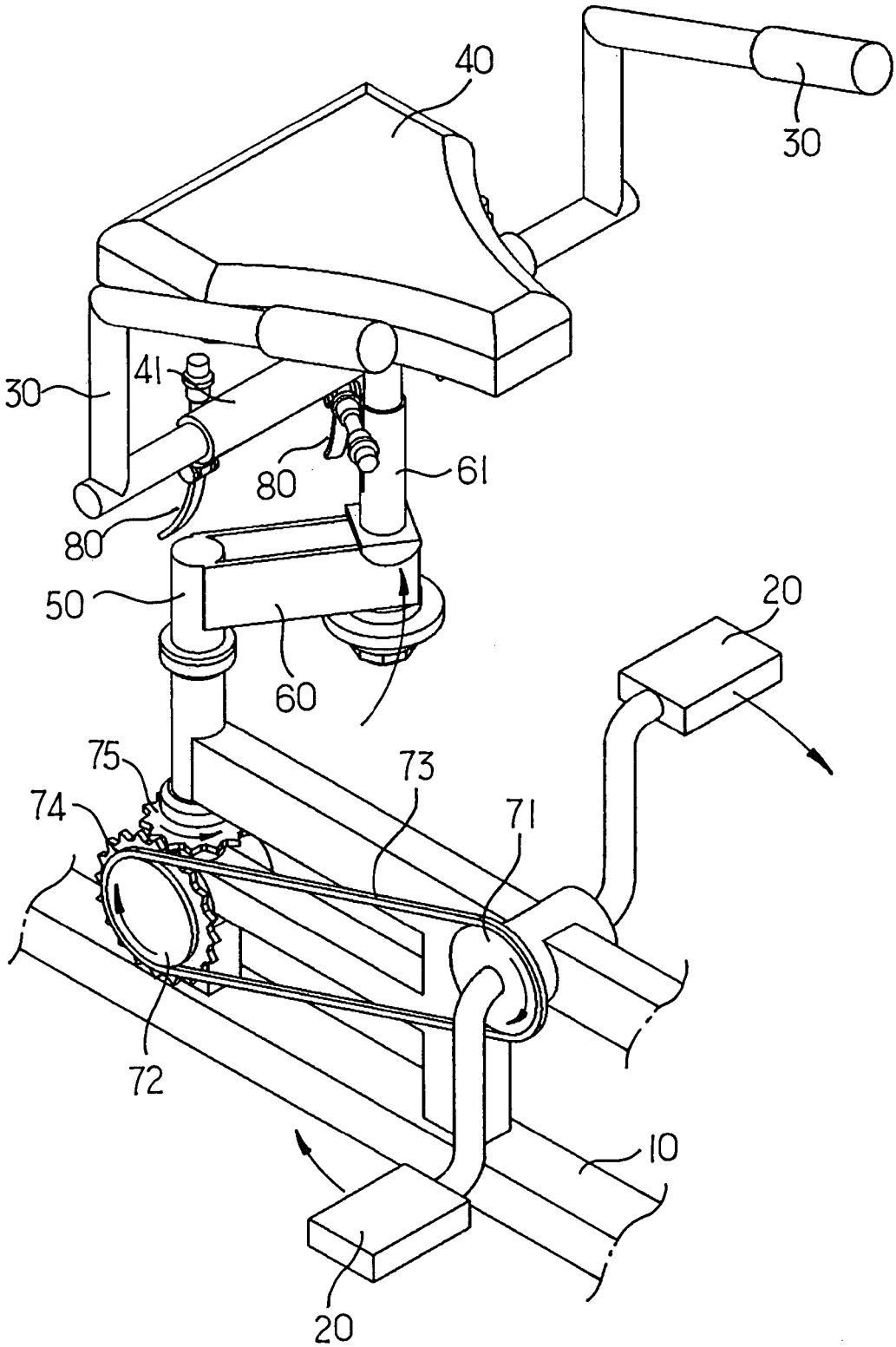
FIG. 4 is a schematic view showing the transmission status of a pair of pedals, the vertical shaft and a seat of the preferred embodiment of the present invention.

As illustrated in FIGS. 3 and 4, a first sprocket 71 is disposed at an axis of the pedal 20 and a second sprocket 72 is located adjacent to where the vertical shaft 50 is inserted to the frame 10. A roller chain 73 is provided between the first and the second sprockets 71, 72. A first gear 74 is separately fixed to the first sprocket 71 while a second gear 75 to engage the first gear 74 is fixed to a bottom of the vertical shaft 50. A through hole 76 is provided at a center of the second gear 75 in the preferred embodiment, illustrated in FIG. 3, to receive the insertion of the lower end of the vertical shaft 50. A coupling is completed when the lower end of the vertical shaft 50 inserted into the through hole 76 and a key 77 is inserted into a key slot 51 for the pedals 20 to properly drive the vertical shaft 50 to revolve through the transmission by the first and the second gears 74, 75.

Figure 6:
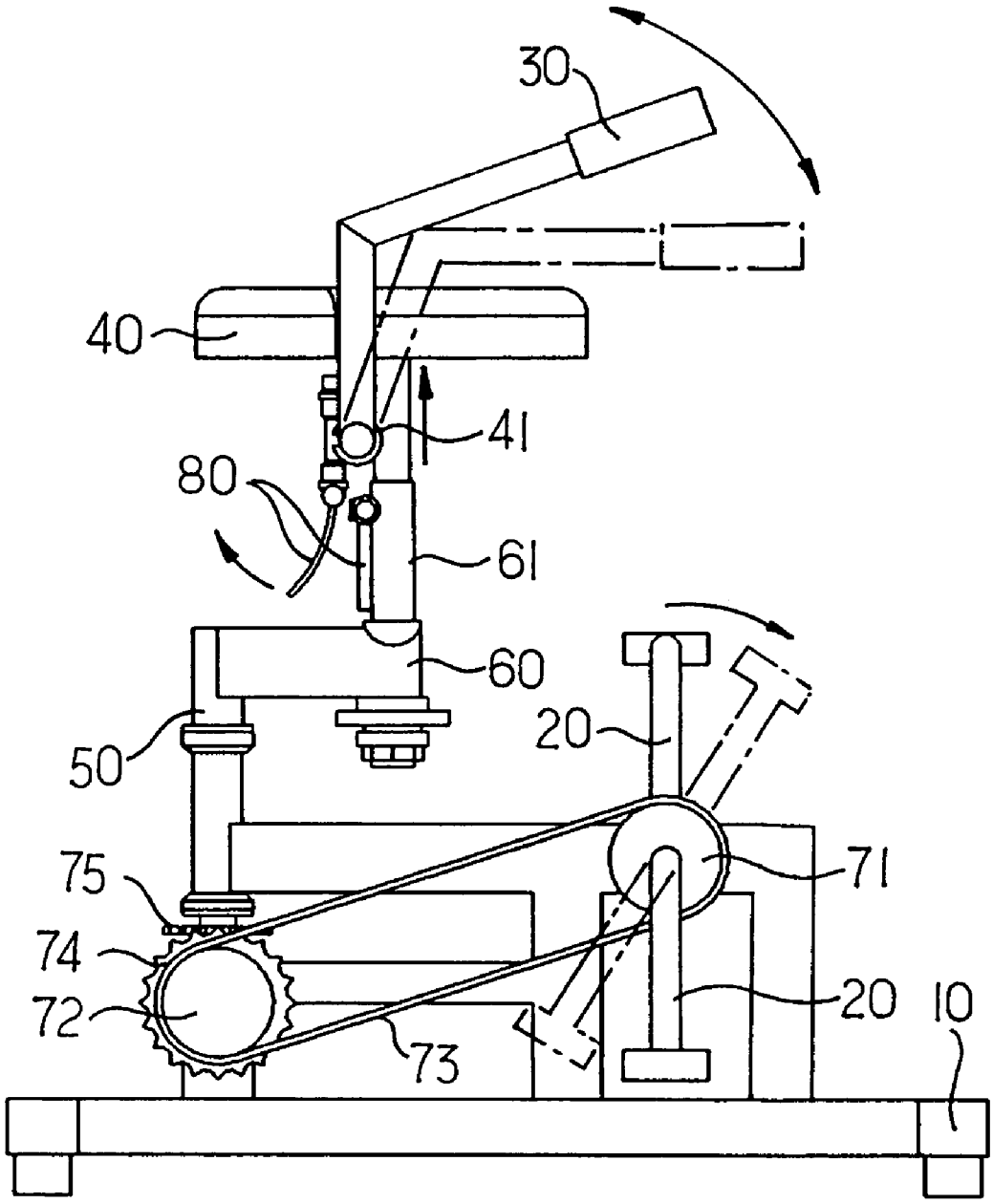
FIG. 6 is a schematic view showing a status of the adjustment of handles of the preferred embodiment of the present invention.

Now referring to FIGS. 1 and 6, a hollow lever 41 is fixed to the bottom of a seat 40, two handles 30 are respectively inserted into both ends of the lever 41 to help the user obtain a solid grasp and support to ensure of exercise safety and varieties of use. Two fast connectors 80 are each fixed to locations where the handles 30 are respectively inserted to both ends of the lever 41 for adjusting a length of the handles and selectively extending the handles to extend towards and away from both sides of the seat 40, and adjusting a elevation of the handles 30.

A similar structure may be utilized for adjusting a height of the seat as illustrated in FIGS. 4 and 6. A sleeve 61 is pivotally connected to a tail of the turning bar 60 and the seat is inserted to the top of the sleeve 61 while a fast connector 80 fixes the seat 40 to the sleeve 61 for the user to adjust a height of the bike, thus upgrading the adaptability of the present invention.

The present invention provides an improved structure for a stationary bike to allow the user to twist waist and swinging buttock while riding the stationary bike to achieve the purpose of staying fit. However, it is to be noted that the preferred embodiments disclosed in the specification and the accompanying drawings are not limiting the present invention; and that any construction, installation, or characteristics that is same or similar to that of the present invention should fall within the scope of the purposes and claims of the present invention.

I claim:

1. A twist stationary bike comprising:

a) a frame having a ground engaging base;

b) a pair of pedals having a common rotary shaft which remains in a stationary orientation with respect to the base;

c) a vertical shaft located on the frame and driven by the pair of pedals;

d) a turning bar having a first end connected to the vertical shaft for rotation therewith and having a second end extending laterally from a top of the vertical shaft;

e) a vertical sleeve pivotally connected to said second end of the turning bar; and f) a seat being inserted into a top of the sleeve, the seat rotating about the vertical shaft.

2. The twist stationary bike according to claim 1, further comprising two handles, one of the two handles is respectively provided on each of two sides of the seat.

3. The twist stationary bike according to claim 2, further comprising a lever fixed to a bottom of the seat, and one of the two handles is respectively provided on each of two ends of the lever.

4. The twist stationary bike according to claim 3, wherein the lever is a hollow lever, one of the two handles is respectively inserted into each of the two ends of the lever and selectively fixed therein by a fast connector.

5. The twist stationary bike according to claim 1, wherein a transmission between the pair of pedals and the vertical shaft is achieved by having a first sprocket located on an axis of the pair of pedals; a second sprocket located where the vertical shaft is inserted into the frame; a roller chain connecting the first sprocket and the second sprocket; a first gear being provided on the first sprocket; and a second gear engaging the first gear being fixed at the lower end of the vertical shaft.

6. The twist stationary bike according to claim 5, wherein the second gear has a through hole located at a center of thereof, a lower end of the vertical shaft is inserted into the through hole; and the second gear and the vertical shaft are coupled to each other with a key and a key slot.

7. The twist stationary bike according to claim 6, further comprising a fast connector selectively fixing the seat to the sleeve.

8. The twist stationary bike according to claim 1, wherein the sleeve is pivotally connected to the second end of the turning bar with a bearing.

* * * * *